US007439929B2

(12) United States Patent
Ozkar

(10) Patent No.: US 7,439,929 B2
(45) Date of Patent: Oct. 21, 2008

(54) TUNING ANTENNAS WITH FINITE GROUND PLANE

(75) Inventor: Mete Ozkar, Raleigh, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 419 days.

(21) Appl. No.: 11/297,337

(22) Filed: Dec. 9, 2005

(65) Prior Publication Data

US 2007/0132654 A1 Jun. 14, 2007

(51) Int. Cl.
*H01Q 1/48* (2006.01)

(52) U.S. Cl. ..... 343/846; 343/700 MS

(58) Field of Classification Search ..... 343/700 MS, 343/702, 846

See application file for complete search history.

(56) References Cited

U.S. PATENT DOCUMENTS 6,624,789 B1 * 9/2003 Kangasvieri et al. ..... 343/702
6,636,179 B1 * 10/2003 Woo et al. ..... 343/700 MS
7,158,089 B2 * 1/2007 Mohammadian et al. .... 343/795
7,324,049 B2 * 1/2008 Myoung et al. ..... 343/700 MS
2003/0080904 A1 * 5/2003 Chen ..... 343/700 MS
2003/0193437 A1 10/2003 Kangasvieri et al.
2006/0001590 A1 * 1/2006 Hung et al. ..... 343/846
2006/0250310 A1 * 11/2006 Yeh et al. ..... 343/702
2007/0109194 A1 * 5/2007 Biddulph ..... 343/700 MS

FOREIGN PATENT DOCUMENTS

EP 0 892 459 A1 1/1999
EP 1 401 050 A1 3/2004

OTHER PUBLICATIONS

International Search Report for PCT/US2006/032713 Mailed Dec. 6, 2006.

* cited by examiner

*Primary Examiner*—Tan Ho
(74) *Attorney, Agent, or Firm*—Harrity & Harrity LLP

(57) ABSTRACT

A method of changing a resonant frequency of an antenna includes coupling the antenna to a ground plane of a circuit board, where the ground plane includes conductive material. The method further includes removing a section of conductive material from a first location of the ground plane, where the shape of the removed section and the first location determine the resonant frequency of the antenna.

22 Claims, 7 Drawing Sheets

TUNING ANTENNAS WITH FINITE GROUND PLANE

TECHNICAL FIELD OF THE INVENTION

Implementations described herein relate generally to tunable antennas and, more particularly, to tuning an antenna using modifications to a ground plane of a circuit board connected to the antenna.

BACKGROUND

In radio communications systems, data is transmitted via electromagnetic waves. The electromagnetic waves are transmitted via antennas, with the carrier frequencies being in the frequency band intended for the respective system. In addition to the requirement to restrict the dimensions of the antenna to fit into the small sizes of the mobile radio transmitting and receiving devices, there is also an increasing requirement for the capability to transmit and receive in multiple different frequency bands, thus, giving the mobile radio devices access to greater bandwidth.

Tunable antennas, therefore, are desirable given the current demand for bandwidth in today's mobile radio designs. Multiple band (e.g., quad-band) antenna design in today's small mobile radio handsets is extremely difficult using the standard inverted F antennas or bent monopole antennas.

SUMMARY

Consistent with principles of the invention, an antenna may be tuned via modifications of the ground plane connected to the antenna, thus, enabling tuning of the antenna without altering the antenna outline. Modifications of the ground plane may include removing conductive material from a section of the ground plane (i.e., making a "cut" in the ground plane) such that ground currents are forced to travel a longer distance through the ground plane to or from the antenna. Since the ground plane size may be comparable in wavelengths to the antenna element itself, this longer distance effectively increases the size of the ground plane and changes the antenna resonant frequency. By controlling the size of the section removed from the ground plane, the resonant frequency of the antenna may be tuned without making a change in the antenna itself. In other implementations, one or more circuit components may be connected to span across the cut in the ground plane. These one or more circuit components may switch different paths across the cut, thus, permitting additional tuning of the antenna resonant frequency at multiple, different specific frequency bands (e.g., quad-band).

According to one aspect, a method of changing a resonant frequency of an antenna may include coupling the antenna to a ground plane of a circuit board, where the ground plane includes a conductive material. The method may further include removing a section of conductive material in a first shape from a first location of the ground plane, where the first shape and the first location determine the resonant frequency of the antenna.

According to another aspect, an apparatus may include a ground plane formed from conductive material on a circuit board in a first shape, where a section of the ground plane at a first location has been omitted or removed to produce a cut in the ground plane in a second shape. The apparatus may further include an antenna coupled to the ground plane.

According to a further aspect, an apparatus may include a circuit board and a ground plane formed from conductive material over the circuit board in a first shape, where the ground plane has a perimeter and an interior and wherein the conductive material is not formed over a section of the circuit board from the perimeter to a location in the interior of the ground plane. The apparatus may further include an antenna coupled to the ground plane.

According to an additional aspect, a method may include forming a conductive ground plane on a circuit board and coupling an antenna to the ground plane. The method may further include modifying a shape of the conductive ground plane formed on the circuit board to cause ground currents to travel through the ground plane a longer distance to or from the antenna.

It should be emphasized that the term "comprises/comprising" when used in this specification is taken to specify the presence of stated features, integers, steps, components or groups but does not preclude the presence or addition of one or more other features, integers, steps, components or groups thereof.

BRIEF DESCRIPTION OF THE DRAWINGS

The accompanying drawings, which are incorporated in and constitute a part of this specification, illustrate one or more embodiments of the invention and, together with the description, explain the invention. In the drawings.

DETAILED DESCRIPTION OF EMBODIMENTS

The following detailed description of the invention refers to the accompanying drawings. The same reference numbers in different drawings may identify the same or similar elements. Also, the following detailed description does not limit the invention.

Figure 1:
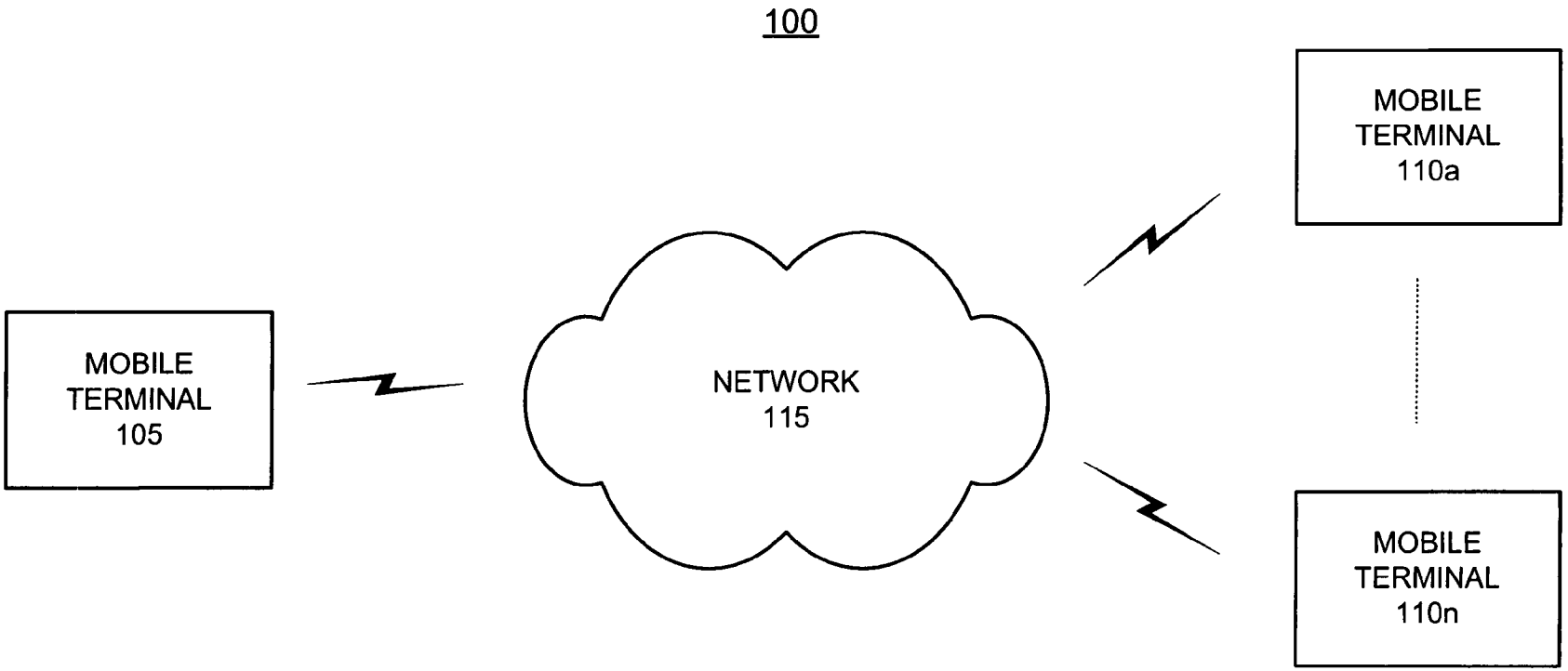
FIG. 1 illustrates an exemplary system in which aspects of the invention may be implemented.

FIG. 1 illustrates an exemplary system 100 in which aspects of the invention may be implemented. System 100 may include mobile terminal 105 connected with mobile terminals 110*a* through 110*n* via network 115 using wireless links. Network 115 may include one or more networks utilizing any type of multi-access media, including a local area network (LAN), metropolitan area network (MAN), satellite network, cellular telephone network or other types of multi-access media/networks.

Mobile terminals 105 and 110*a*-110*n* may be similarly constructed and may include telephones, cellular radiotelephones, Personal Communications System (PCS) terminals or the like. PCS terminals may combine a cellular radiotelephone with data processing, facsimile and data communications capabilities. Mobile terminals 105 and 110*a*-110*n* may further include personal digital assistants (PDAs), conventional laptops and/or palmtop receivers, or other appliances that include radiotelephone transceivers, or the like. PDAs may include radiotelephones, pagers, Internet/intranet access, web browsers, organizers, calendars and/or global positioning system (GPS) receivers. Mobile terminals 105 and 110*a*-110*n* may further be referred to as "pervasive computing" devices.

Figure 2:
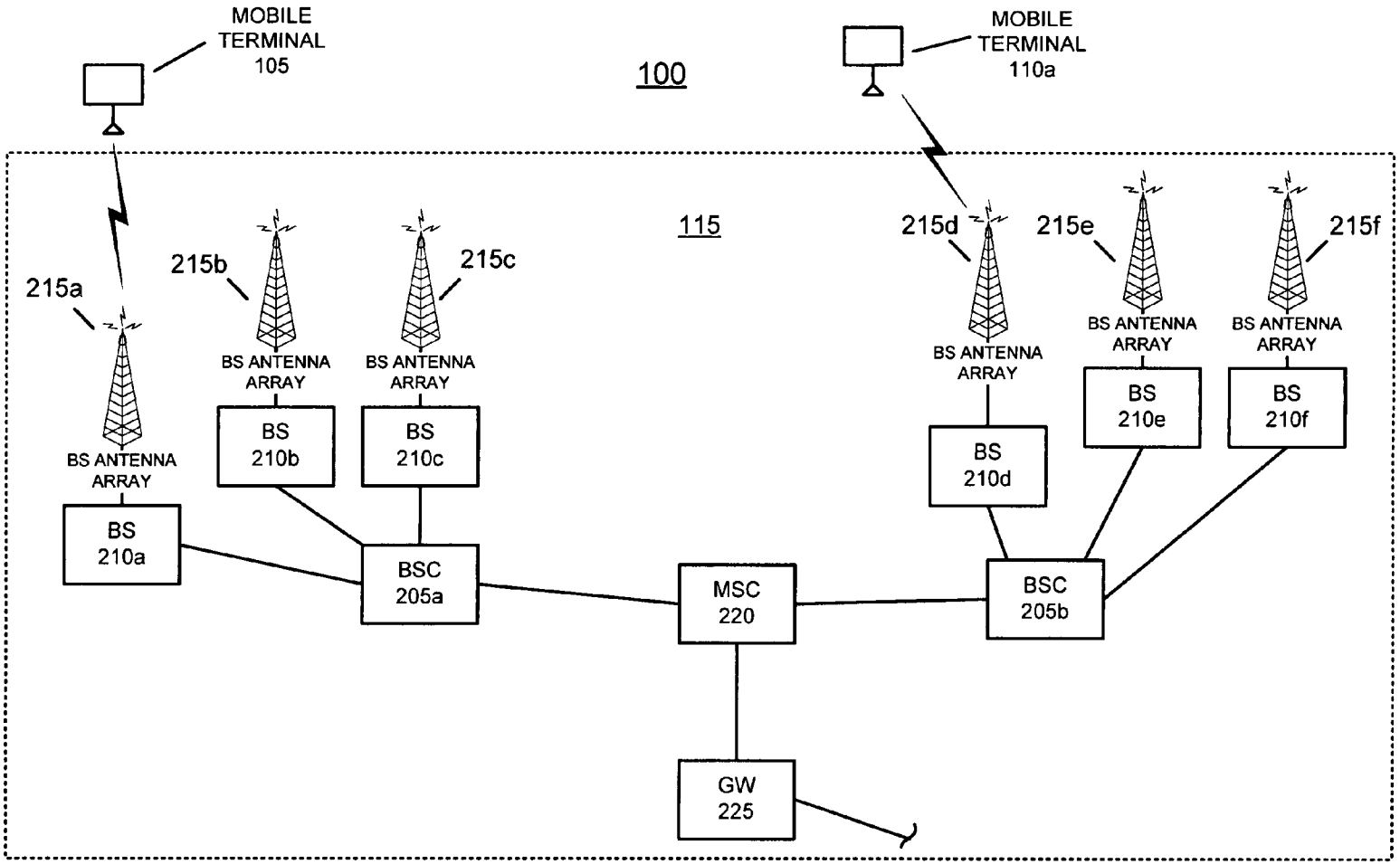
FIG. 2 illustrates an exemplary system that includes a cellular network consistent with principles of the invention.

FIG. 2 illustrates one example of system 100 implemented using a cellular network. System 100 may include mobile terminals 105 and 110*a* and a cellular network 115. Cellular network 115 may include one or more base station controllers (BSCs) 205*a*-205*b*, multiple base stations (BSs) 210*a*-210*f*, multiple base station antenna arrays 215*a*-215*f*, one or more mobile switching centers (MSCs), such as MSC 220, and one or more gateways (GWs), such as GW 225.

Cellular network 115 consists of components conventionally used for transmitting data to and from mobile terminals 105 and 110*a*-110*n*. Such components may include base station antenna arrays 215*a*-215*f*, which transmit and receive, via appropriate data channels, data from mobile terminals within their vicinity. Base stations 210*a*-210*f* connect to their respective antenna arrays 215*a*-215*f*, and format the data transmitted to, or received from the antenna arrays 215*a*-215*f* in accordance with conventional techniques, for communicating with BSCs 205*a*-205*b* or a mobile terminal, such as mobile terminal 105. Among other functions, BSCs 205*a*-205*b* may route received data to either MSC 220 or a base station (e.g., BS's 210*a*-210*c* or 210*d*-210*f*). MSC 220 routes received data to BSC 205*a* or 205*b*. GW 225 may route data received from an external domain (not shown) to an appropriate MSC (such as MSC 220), or from an MSC to an appropriate external domain.

Figure 3:
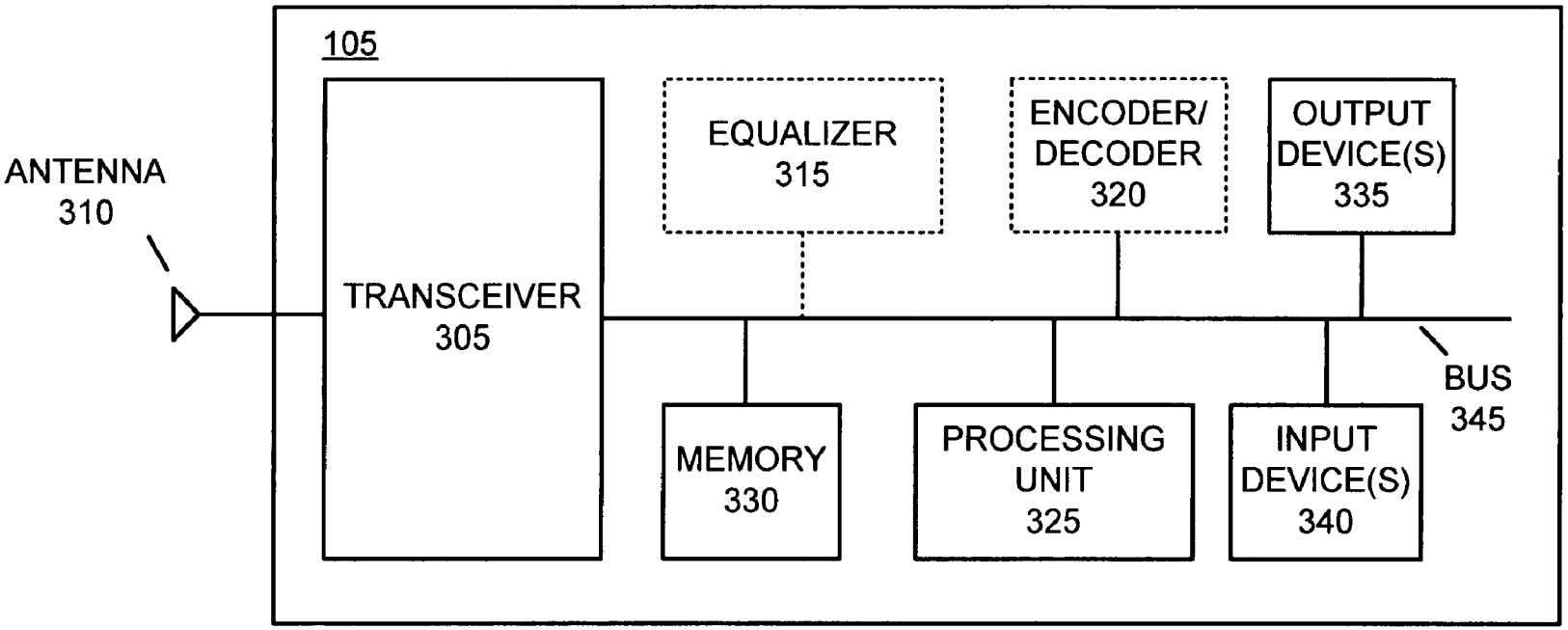
FIG. 3 illustrates an exemplary mobile terminal consistent with principles of the invention.

FIG. 3 illustrates an exemplary mobile terminal (MT) 105 consistent with the present invention. Mobile terminal 105 may include a transceiver 305, an antenna 310, an optional equalizer 315, an optional encoder/decoder 320, a processing unit 325, a memory 330, an output device(s) 335, an input device(s) 340, and a bus 345.

Transceiver 305 may include transceiver circuitry well known to one skilled in the art for transmitting and/or receiving symbol sequences in a network, such as network 115, via antenna 310. Transceiver 305 may include, for example, a conventional RAKE receiver. Transceiver 305 may further include mechanisms for estimating the signal-to-interference ratio (SIR) of received symbol sequences. Transceiver 305 may additionally include mechanisms for estimating the propagation channel Doppler frequency.

Equalizer 315 may store and implement Viterbi trellises for estimating received symbol sequences using, for example, a maximum likelihood sequence estimation technique. Equalizer 315 may additionally include mechanisms for performing channel estimation.

Encoder/decoder 320 may include circuitry for decoding and/or encoding received or transmitted symbol sequences. Processing unit 325 may perform all data processing functions for inputting, outputting, and processing of data including data buffering and terminal control functions, such as call processing control, user interface control, or the like. Memory 330 provides permanent, semi-permanent, or temporary working storage of data and instructions for use by processing unit 325 in performing processing functions. Memory 330 may include large-capacity storage devices, such as a magnetic and/or optical recording medium and its corresponding drive. Output device(s) 335 may include mechanisms for outputting data in video, audio, and/or hard copy format. Input device(s) 340 permit entry of data into mobile terminal 105 and may include a user interface and a microphone (not shown). The microphone can include mechanisms for converting auditory input into electrical signals. Bus 345 interconnects the various components of mobile terminal 105 to permit the components to communicate with one another. The configuration of components of mobile terminal 105 illustrated in FIG. 3 is for illustrative purposes only. One skilled in the art will recognize that other configurations may be implemented.

Figure 4:
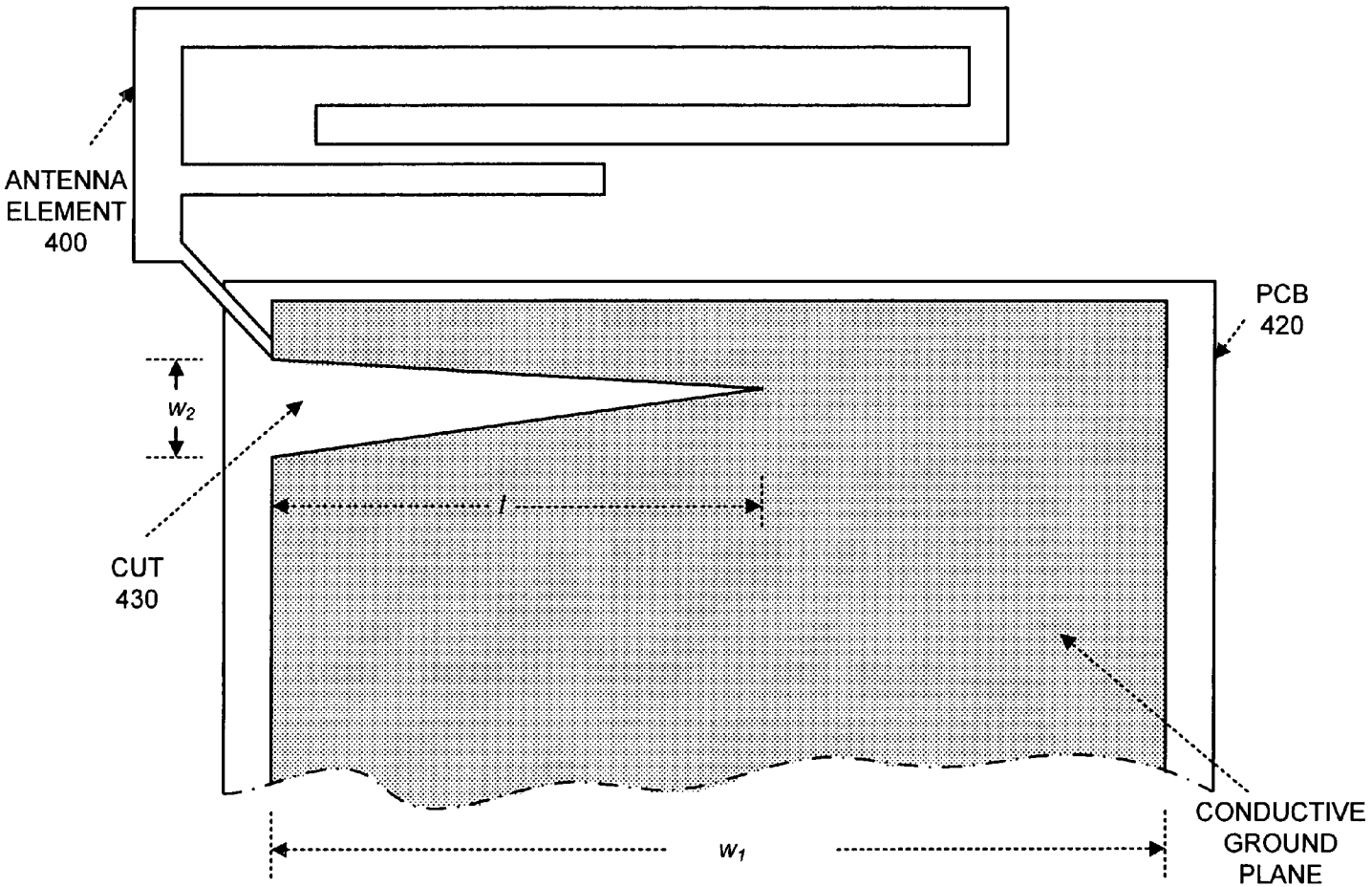
FIG. 4 illustrates exemplary modifications to a circuit board conductive ground plane for antenna resonant frequency tuning consistent with principles of the invention.

FIG. 4 illustrates an antenna element 400 of antenna 310 coupled to a conductive ground plane 410 located on a printed circuit board (PCB) 420 of mobile terminal 105 consistent with principles of the invention. For purposes of simplification, the coupling of antenna element 400 to ground plane 410 in FIG. 4 is illustrated as a direct connection. Antenna element 400, however, typically may be directly connected to transceiver 305 (not shown) and may be coupled to ground plane 410 via intervening circuitry of transceiver 305. PCB 420 may include the circuitry (not shown) for implementing the various components (e.g., transceiver 305, equalizer 315, encoder/decoder 320, processing unit 325, memory 330, etc.) of mobile terminal 105. Ground plane 410 may have a width $w_1$, as shown in FIG. 4. Ground plane 410, as shown in FIG. 4, represents a typical shape and configuration of a ground plane located on a typical PCB of a mobile terminal. Ground plane 410, however, may have any shape and/or configuration consistent with principles of the invention.

As shown in FIG. 4, a "cut" 430 may be made into ground plane 410. Making the cut 430 into conductive ground plane 410 may involve removing selected portions of the conductive material of ground plane 410 in a desired shape, or it may involve forming the conductive material of ground plane 410 in a desired shape that includes cut 430 at the time ground plane 410 is formed on PCB 420. Cut 430 may have a length l and a width $w_2$. In one exemplary implementation, width $w_1$, may be 40 mm, width $w_2$ may be 2 mm and length l may be 18 mm. Selection of appropriate values for $w_1$, $w_2$ and l may be based on bandwidth and tunability requirements and electromagnetic simulations. Cut 430 is shown for illustrative purposes as a "wedge" shaped cut extending from the perimeter of ground plane 410 into the interior of ground plane 410. However, different sizes, shapes and locations of cut 430 may be used. In some implementations, cut 430 may be made through all of the layers in PCB 420. Cut 430 forces ground currents in ground plane 410 (i.e., the main source of radiation at low frequency bands) to travel a longer distance. This longer distance effectively increases the antenna size and, thus, reduces the antenna's resonant frequency. By controlling the size of cut 430, the antenna's resonant frequency can be tuned without making a change in the antenna element itself. The location and shape of cut 430 should be made such that the path that ground currents must travel to or from antenna element 400 via the connection to ground plane is increased relative to an "un-cut" ground plane. The dimensions of cut 430 in ground plane 410 also determine how much tuning of the antenna resonant frequency can be achieved.

The use of cut 430 in ground plane 410 may particularly apply to systems where the ground plane size determines the radiation characteristics. For example, if the ground plane size is smaller than half the wavelength (such as mobile radio devices operating at 850-900 MHz bands), the radiation from ground plane 410 will be dominant. Implementations of the invention can have potential application in areas where near fields play an important role (such as SAR—specific absorption rate and HAC—hearing aid compatibility in mobile radio devices).

Figure 5:
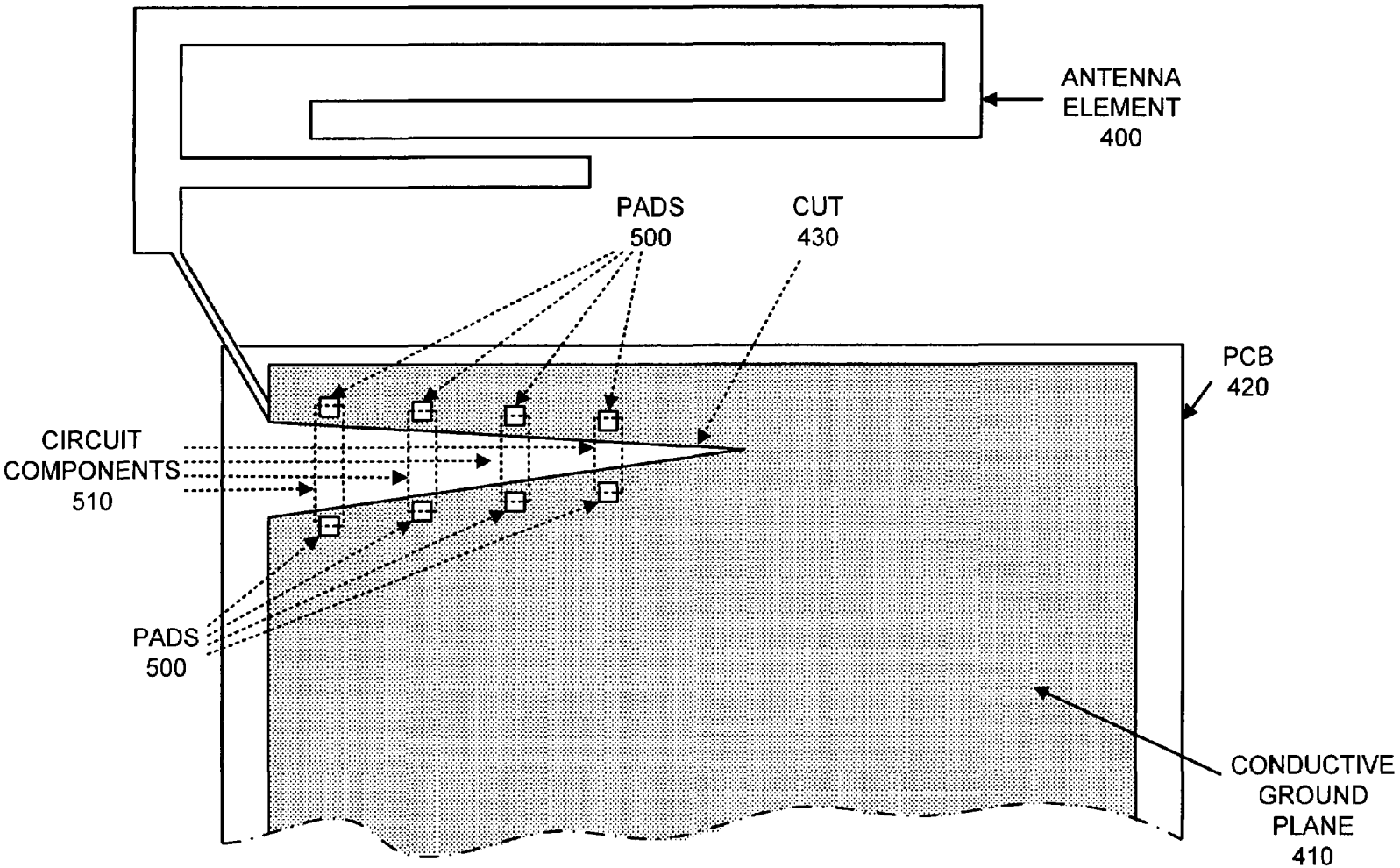
FIG. 5 illustrates the use of circuit components, in addition to the exemplary modifications of the ground plane of FIG. 4, for antenna resonant frequency tuning.

FIG. 5 illustrates another implementation of the invention in which pads 500 are located at selected positions adjacent cut 430 on ground plane 410, and one or more circuit components 510 are connected to ground plane 410 via mounting on respective pads 500 such that they span across cut 430. Four circuit components 510 are shown in FIG. 5 for illustrative purposes only, and may have application, for example, in a "quad-band" radio device. Circuit components 510 may include only a single circuit component, or may include multiple circuit components that span across cut 430. Each of circuit components 510 may include a capacitor (e.g., a ferroelectric capacitor), an inductor, a resistive element (e.g., a zero ohm resistor), a capacitor, inductor or resistive element in series with a switch, or a micro-electro-mechanical systems (MEMS) switching device. Circuit components 510 may be used for selectively switching different paths across cut 430 through ground plane 410 to antenna element 400, thus, permitting different resonant frequencies to be tuned. Each of circuit components 510 may be selectively switched across cut 430 using, for example, a switch or relay connected to each of the circuit components 510 that may be controlled by an external controller (not shown). The location of each circuit component 510 with respect to cut 430 determines the distance that current will have to travel through ground plane 410 to or from antenna 400, thus, determining the effective length of antenna element 400. Circuit components 510 may, therefore, each be used for tuning antenna element 400 at multiple different frequency bands.

Figure 6:
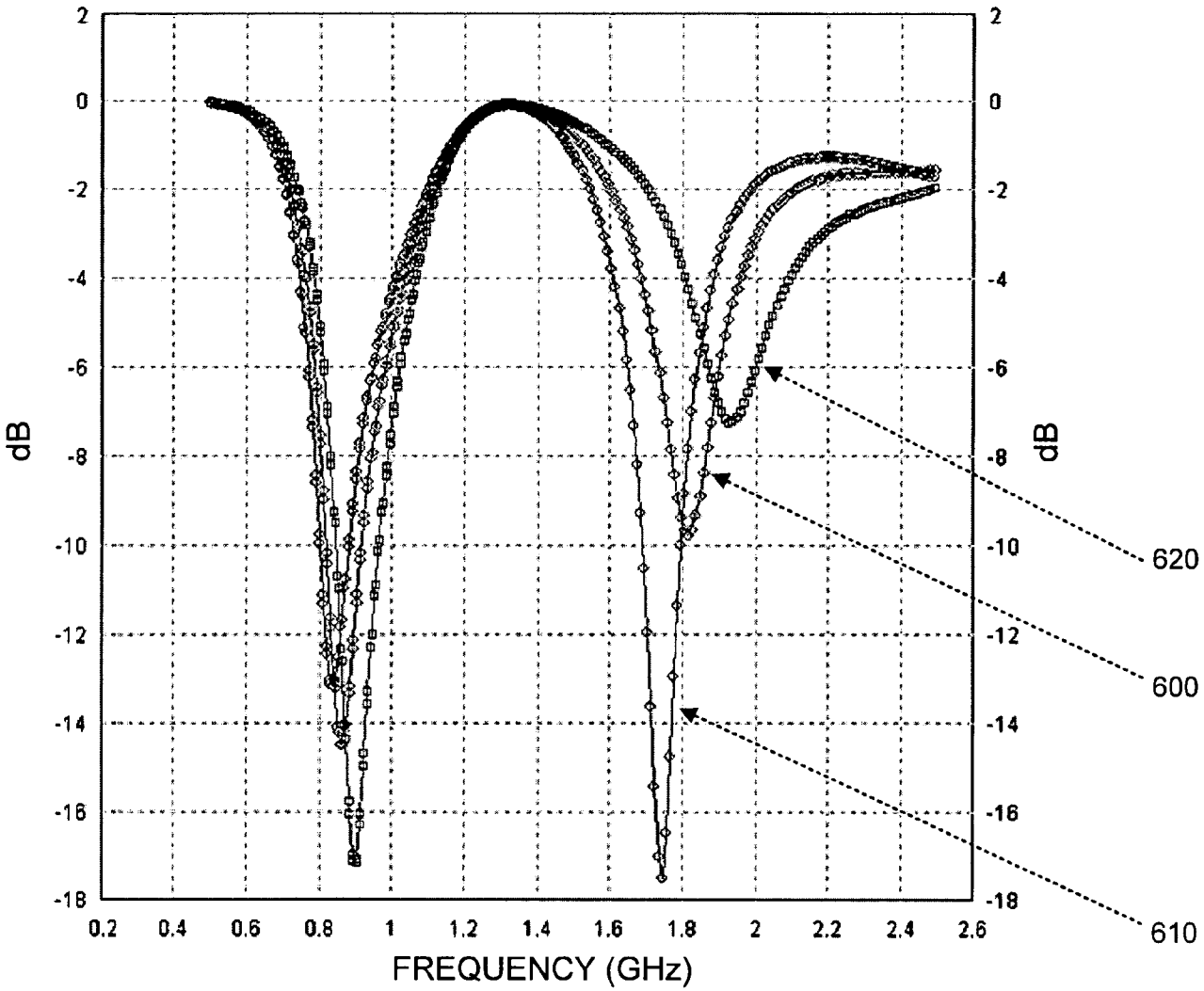
FIG. 6 illustrates an exemplary graph that models antenna return loss for different ground plane modifications consistent with principles of the invention.

FIG. 6 illustrates an exemplary graph that models antenna return loss versus frequency for different ground plane modifications consistent with principles of the invention. As shown in FIG. 6, a plot 600 of antenna return loss (in dB versus frequency) for a smaller cut 430 is substantially different than a plot 610 of antenna return loss for a larger cut 430. As further shown in FIG. 6, placing a zero ohm resistive element across cut 430, thus, "shorting" a path across cut 430 results in a substantially different plot 620 of antenna return loss versus frequency. As can be seen from the modeled plots 600, 610, 620, adjustment of the size of cut 430 and the addition of circuit components to selectively span across cut 430 can change the resonant frequency of the antenna coupled to ground plane 410.

Exemplary Ground Plane Modification Process

Figure 7:
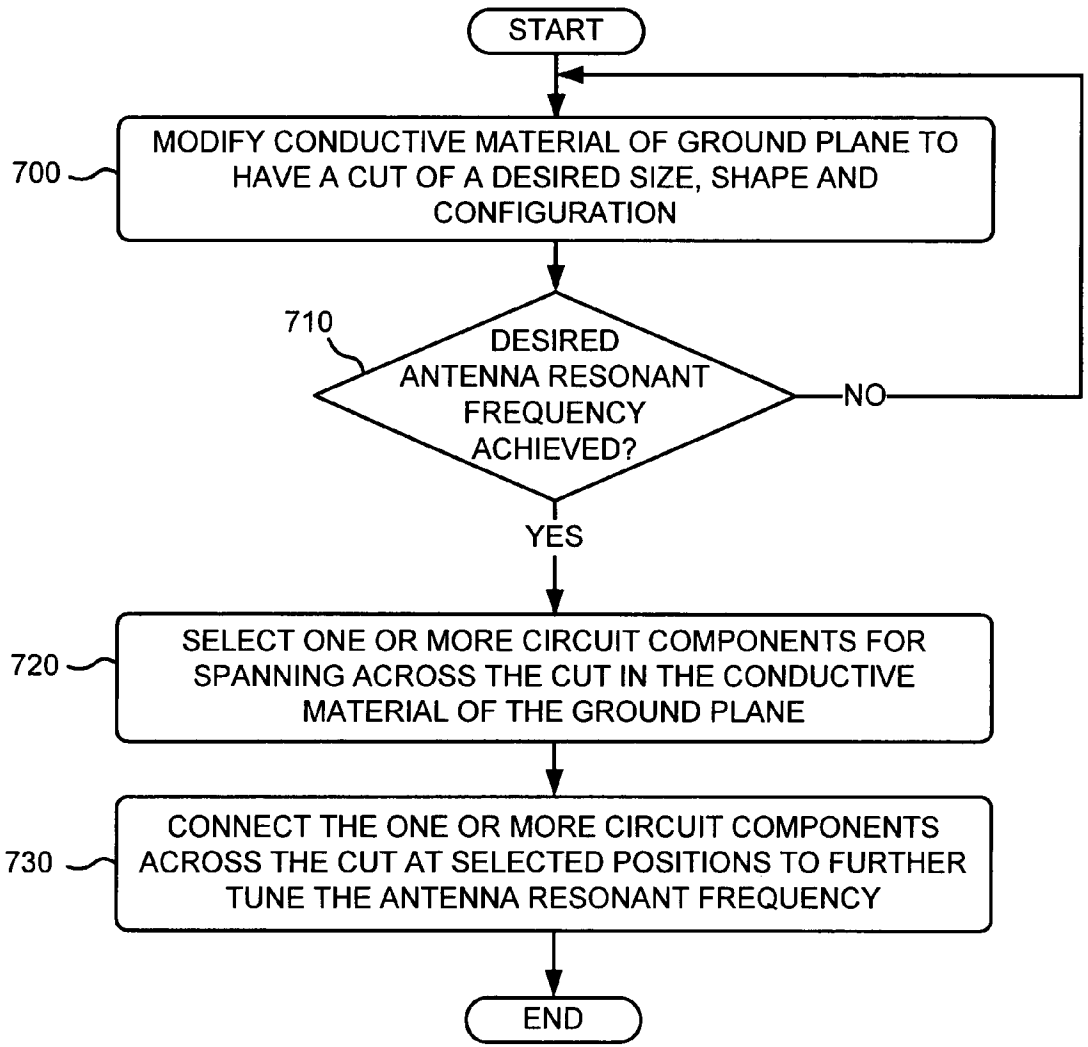
FIG. 7 is a flowchart of an exemplary process for tuning an antenna resonant frequency using circuit board ground plane modifications consistent with principles of the invention.

FIG. 7 is a flowchart of an exemplary process for modifying a ground plane of a circuit board to tune an antenna's resonant frequency. The exemplary process may begin with the modification of the conductive material of a circuit board ground plane (e.g., conductive ground plane 410) to have a cut of a desired size, shape and configuration (block 700). Modifying of the conductive material may involve removing selected portions of the conductive material of the ground plane in a desired shape, or it may involve forming the conductive material of ground plane in a desired shape that includes the desired cut at the time ground plane is formed on the circuit board. The location and shape of the cut should be made such that the path that ground currents must travel to or from the antenna via the connection to ground plane is increased relative to an "un-cut" ground plane. The dimensions of the cut in the ground plane determine how much tuning of the antenna resonant frequency can be achieved. Thus, in addition to changing the resonant frequency of the antenna, the cut in the ground plane affects the "tunability" of the resonant frequency of the antenna.

Once the antenna is connected to the ground plane, the resonant frequency of the antenna may be tested to verify that the desired resonant frequency has been achieved (block 710). If modification of the ground plane (e.g., ground plane 410) results in the desired antenna resonant frequency (YES-block 710), then one or more circuit components may be selected for spanning across the cut in the conductive material of the ground plane (optional block 720). The circuit components may include components 510 as described above with respect to FIG. 5. If modification of the ground plane (e.g., ground plane 410) does not result in the desired antenna resonant frequency, then the exemplary process may return to block 700 with further modification of the conductive material of the ground plane.

Returning to block 720, once the one or more circuit components are selected, the components may be connected across the cut in the ground plane at selected positions to further tune the antenna resonant frequency (block 730). The circuit components connected across the cut in the ground plane may subsequently be used, either singly, or in combination, to tune the resonant frequency of the antenna connected to the ground plane at one or more frequency bands.

CONCLUSION

The foregoing description of implementations consistent with principles of the invention provides illustration and description, but is not intended to be exhaustive or to limit the invention to the precise form disclosed. Modifications and variations are possible in light of the above teachings, or may be acquired from practice of the invention. For example, while a series of acts has been described with regard to FIG. 7, the order of the acts may be modified in other implementations consistent with the principles of the invention. Further, non-dependent acts may be performed in parallel. Aspects of the invention have been described as being implemented in mobile terminals, such as, for example, cellular phones. The principles of the invention as described herein, however, may be equally applied to any type of device having an antenna that also has a finite ground plane with a size that is comparable to the resonant wavelength.

One skilled in the art will recognize that the principles of the present invention may be applied to any wired or wireless system utilizing any type of multi-access scheme, such as TDMA, CDMA or FDMA. It should be further understood that the principles of the present invention may be utilized in hybrid systems that are combinations of two or more of the above multi-access schemes. In addition, a communication device, in accordance with the present invention, may be designed to communicate with, for example, a base station transceiver using any standard based on GSM, TDMA, CDMA, FDMA, a hybrid of such standards or any other standard.

It will be apparent to one of ordinary skill in the art that aspects of the invention, as described above, may be implemented in many different forms of software, firmware, and hardware in the implementations illustrated in the figures. The actual software code or specialized control hardware used to implement aspects consistent with the principles of the invention is not limiting of the invention.

No element, act, or instruction used in the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A method of changing a resonant frequency of an antenna, comprising:

coupling the antenna to a ground plane of a circuit board, where the ground plane comprises a conductive material; and removing or omitting a section of conductive material in a first shape from a first location of the ground plane, where the first shape and the first location determine the resonant frequency of the antenna and where removing or omitting the section of conductive material in the first shape produces a cut in the ground plane;

connecting a first circuit component to a first side of the cut in the ground plane and to a second side of the cut in the ground plane at a first position relative to the cut; and connecting a second circuit component to the first side of the cut in the ground plane and to the second side of the cut in the ground plane at a second position relative to the cut that is different than the first position.

2. The method of claim 1, where removing or omitting the section of conductive material in the first shape from the first location from ground plane causes ground currents to travel through the ground plane a longer distance to or from the antenna than if the conductive material is not removed or omitted.

3. The method of claim 2, where causing the ground currents to travel the longer distance effectively increases a size of the antenna.

4. The method of claim 3, where effectively increasing the size of the antenna changes the resonant frequency of the antenna.

5. An apparatus, comprising:

a ground plane formed in a first shape from conductive material on a circuit board shape, where a section of the ground plane at a first location has been omitted or removed to produce a cut in the ground plane in a second shape;

a first circuit component connected to a first side of the cut in the ground plane and to a second side of the cut in the ground plane at a first position relative to the cut;

a second circuit component connected to the first side of the cut in the ground plane and to the second side of the cut in the ground plane at a second position relative to the cut that is different than the first position; and an antenna coupled to the ground plane.

6. The apparatus of claim 5, where the cut in the ground plane forces ground currents to travel through the ground plane a longer distance to or from the antenna than if the cut does not exist.

7. The apparatus of claim 6, where forcing the ground currents to travel the longer distance effectively increases a size of the antenna.

8. The apparatus of claim 7, where effectively increasing the size of the antenna changes a resonant frequency of the antenna.

9. The apparatus of claim 5, where the cut in the ground plane in the second shape extends from a perimeter of the ground plane towards an interior of the ground plane.

10. The apparatus of claim 5, where the first circuit component changes a resonant frequency of the antenna.

11. The apparatus of claim 5, where the first circuit component is connected to span across the cut in the ground plane at the first position.

12. The apparatus of claim 5, where the first circuit component comprises at least one of a capacitor, an inductor, a switch, a resistive element or a micro-electro-mechanical systems (MEMS) device.

13. The apparatus of claim 5, where the second circuit component changes a resonant frequency of the antenna.

14. The apparatus of claim 5, where the second circuit component is connected to span across the cut in the ground plane at the second position.

15. The apparatus of claim 5, where the second circuit component comprises at least one of a capacitor, an inductor, a switch, a resistive element or a micro-electro-mechanical systems (MEMS) device.

16. An apparatus, comprising:

a ground plane formed in a first shape from conductive material on a circuit board, where a section of the ground plane at a first location has been omitted or removed to produce a cut in the ground plane in a second shape;

an antenna coupled to the ground plane;

a first circuit component connected in series with a first switch to a first side of the cut in the ground plane and to a second side of the cut in the ground plane at a first position; and a second circuit component connected in series with a second switch to the first side of the cut in the ground plane and to the second side of the cut in the ground plane at a second position that differs from the first position.

17. The apparatus of claim 16, where the cut in the ground plane forces ground currents to travel through the ground plane a longer distance to or from the antenna than without the cut, effectively increasing a size of the antenna and changing a resonant frequency of the antenna.

18. The apparatus of claim 16, where the cut in the ground plane in the second shape extends from a perimeter of the ground plane towards an interior of the ground plane.

19. The apparatus of claim 16, where switching in the first and second circuit components using the first and second switches changes the resonant frequency of the antenna.

20. The apparatus of claim 16, where the first circuit component is connected to span across the cut in the ground plane at the first position and where the second circuit component is connected to span across the cut in the ground plane at the second position.

21. The apparatus of claim 16, where the first circuit component comprises at least one of a capacitor, an inductor or a resistive element.

22. The apparatus of claim 21, where the second circuit component comprises at least one of a capacitor, an inductor or a resistive element.

* * * * *

UNITED STATES PATENT AND TRADEMARK OFFICE

CERTIFICATE OF CORRECTION

PATENT NO. : 7,439,929 B2
APPLICATION NO. : 11/297337
DATED : October 21, 2008
INVENTOR(S) : Mete Ozkar It is certified that error appears in the above-identified patent and that said Letters Patent is hereby corrected as shown below:

Column 7, line 34 reads: “material on a circuit board shape, where a section of the”, and should correctly read as follows: “material on a circuit board, where a section of the”.

Signed and Sealed this

Twenty-third Day of December, 2008

JON W. DUDAS
*Director of the United States Patent and Trademark Office*